US006098613A

United States Patent [19]

Wiersma

[11] Patent Number: 6,098,613

[45] Date of Patent: Aug. 8, 2000

[54] VENTING SYSTEM FOR GAS OVEN

[75] Inventor: Wouter J. Wiersma, Arcadia, Calif.

[73] Assignee: Distinctive Appliances, Inc., Pasadena, Calif.

[21] Appl. No.: 09/291,526

[22] Filed: Apr. 14, 1999

[51] Int. Cl.[7] ..... F24C 15/20

[52] U.S. Cl. ..... 126/273 R; 126/21 R; 126/19 R

[58] Field of Search ..... 126/21 R, 21 A, 126/299 R, 41 R, 39 R, 273 R, 19 R, 299 D

[56] References Cited

U.S. PATENT DOCUMENTS

| | | | |
|---|---|---|---|
| 2,452,715 | 11/1948 | Bauer | 126/21 R |
| 2,540,627 | 2/1951 | Mayer | 126/21 R |
| 2,779,326 | 1/1957 | Kamin | 126/21 R |
| 3,267,924 | 8/1966 | Payne | 126/41 R |
| 4,211,909 | 7/1980 | Yoshida et al. | 126/273 R |

FOREIGN PATENT DOCUMENTS

| | | | |
|---|---|---|---|
| 3246628 | 6/1984 | Germany | 126/21 R |
| 562089 | 5/1957 | Italy | 126/21 R |

*Primary Examiner*—Carl D. Price
*Attorney, Agent, or Firm*—Lyon & Lyon LLP

[57] ABSTRACT

A venting system for a gas oven of a cooking range that also has a cooktop portion. The venting system includes a flat duct above the oven on each side that communicates with an elongated opening in the top of the oven on that side and the duct conducts the gases of combustion from the oven upwardly to the lateral edges of the cooktop. A vent manifold is mounted on the top along each lateral edge of the cooktop and communicates with the duct on that side to distribute the exhaust gases forwardly and rearwardly along both lateral sides of the cooktop, whereby normal operation of the cooktop gas burners is not adversely affected, no hot spots of exhaust gases from the oven are created, and the working depth of the cooktop is maximized.

29 Claims, 4 Drawing Sheets

VENTING SYSTEM FOR GAS OVEN

This invention relates to cooking ovens that include gas burners, either as the bottom heating element or the top broiler element, and specifically to the venting system for allowing the discharge of the products of combustion of the gas and air from the oven.

Conventional cooking ovens that are heated by burning gas, either natural gas or vaporized liquid petroleum gas, draw in fresh air through the burner units that mix the gas with the air for combustion and the gaseous products of combustion must be discharged or escape from the oven cavity. A gas burner is located in the bottom of the oven for general baking and cooking. Also, a gas burner may be provided at the top of the oven as either an open flame burner or an infrared type burner having ceramic radiants that are heated toa glowing temperature by the burning gas/air mixture. During heating there is a continual supply of gas and air that is combusted and those gaseous products of combustion are normally vented to the atmosphere through the upper rear portion of the oven cavity through the upper wall or rear wall into the kitchen or out through a duct. When the gas oven is combined with a cooktop, which may have gas or electric burners or both, such as in a cooking range that is either free standing or adapted to be built-in, the exhaust gases from the oven are normally vented through the top rear edge of the range which then reduces the depth of the usable cooking space on a cooktop since the rear vents must be left open. Some gas ranges have been provided with the venting at the center of the cooktop directly from the center of the top wall of the oven but this creates undesirable heating in the middle of the cooktop and increases the difficulty in cleaning the cooktop.

It is an object of this invention to provide a novel venting system for gas ovens wherein the gases of combustion from the oven are vented upwardly from the top of each side of the oven to maximize the depth of the oven without increasing the width of the oven.

Another object of the present invention is to provide a venting system for a gas oven in a cooking range wherein the gases of combustion from the oven are vented from above each side of the oven through the cooktop portion of the range on each side through manifolds along each side extending from front to back whereby the usable depth of the cooktop is maximized and the width of the cooktop and range are not increased by reason of the side venting system. Still further, an object of this invention is to provide such a cooking range wherein the top vents from the oven on each side are located at the center from front to back and the manifold distributes the gases of combustion toward the front and rear for even distribution of the exhaust gases, which avoids hot spots from the vented gases and also avoids adverse affects on the cooktop burners if they are gas burners.

Other and more detailed objects and advantages of the present invention will readily appear to those skilled in the art from the following description of a preferred embodiment with alternative forms thereof and the accompanying drawings, wherein.

Figure 1:
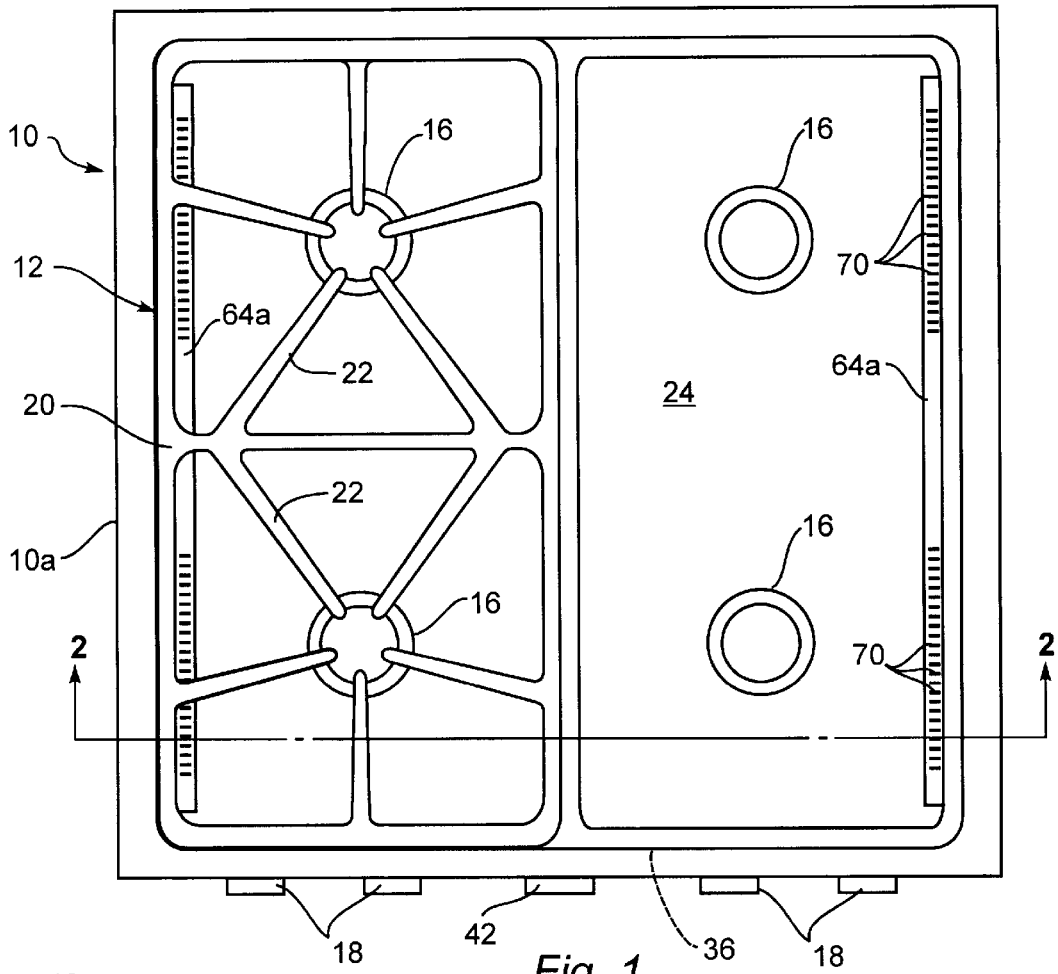
FIG. 1 is a diagrammatic plan view of a cooking range having a cooktop and an oven with the venting system of the present invention, with the right-hand cooking grate removed for clarity of illustration.
Figure 2:
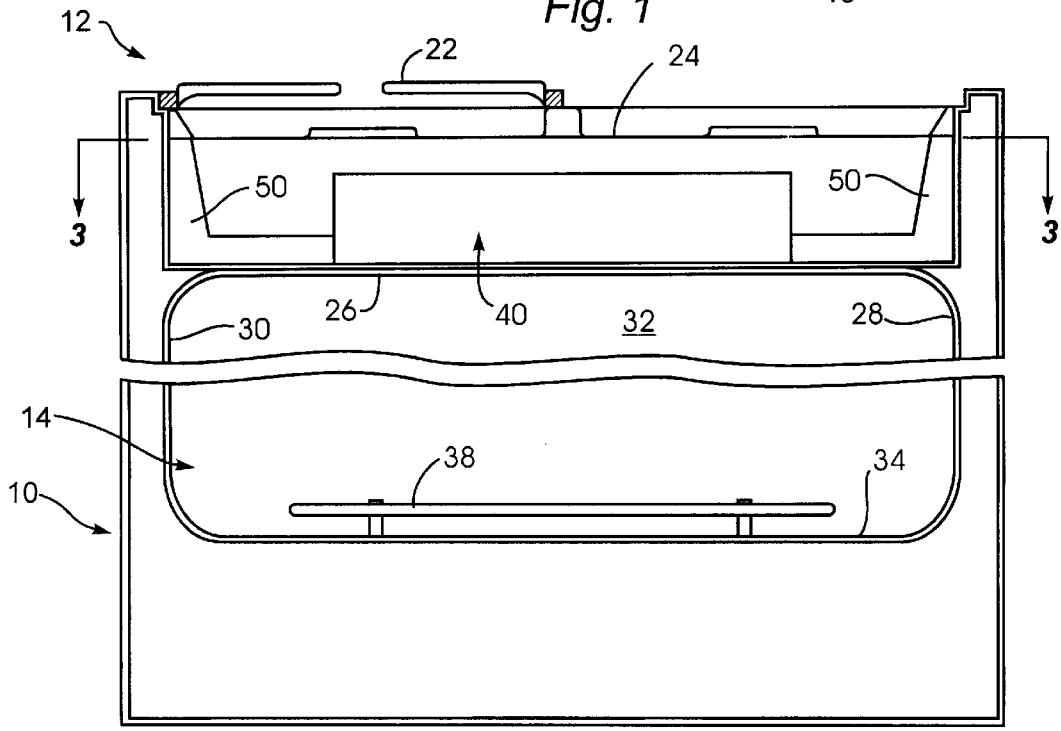
FIG. 2 is a diagrammatic sectional elevation of the cooking range taken substantially on line 2—2 of FIG. 1.
Figure 3:
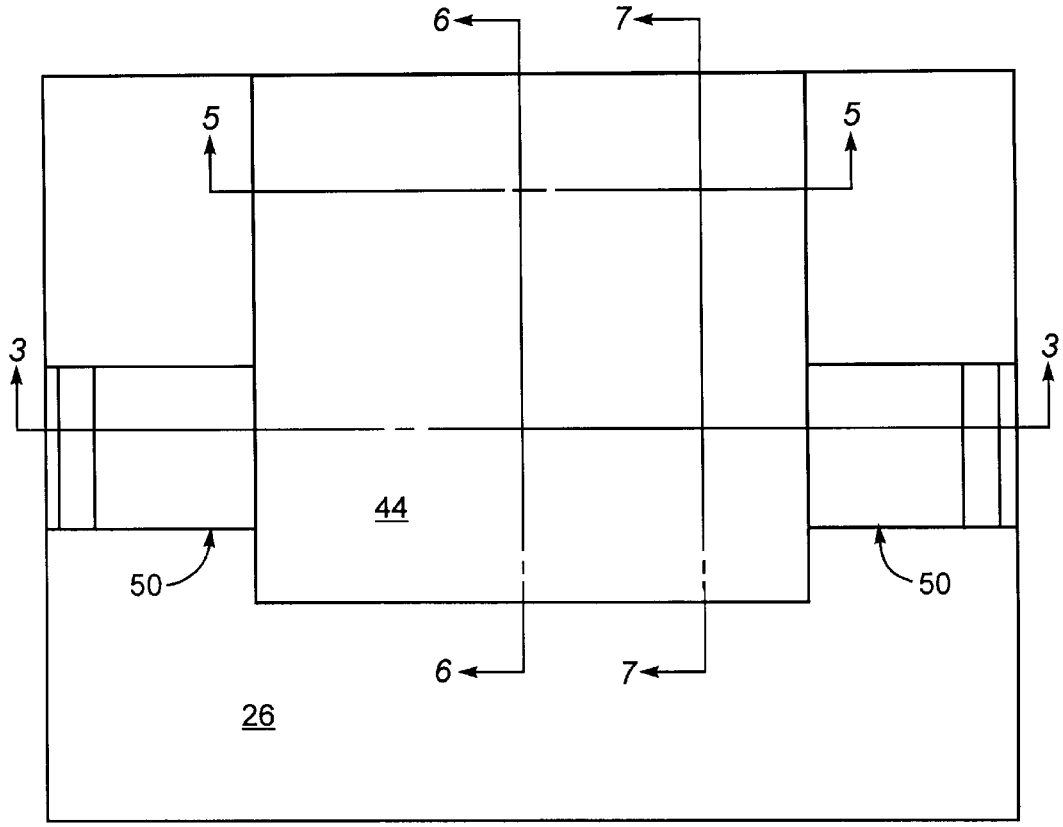
FIG. 3 is a diagrammatic sectional plan view of a cooking range taken substantially on the line 3—3 of FIG. 2 at a location immediately below the drip tray of the cooktop, and with the exterior walls of the range omittede for clarity of illustration.

Referring now to FIGS. 1 and 2, a cooking range 10 of the free-standing type having both a cooktop portion 12 and a cooking oven 14 is illustrated. The cooktop 12 is illustrated as having four gas burners 16 but the cooktop 12 could be provided with more burners and one or more of the burners could be replaced with electric heating elements. The four burners 16 are individually controlled by the four knobs 18 in a conventional manner. A removable grate 20 is provided on top of the cook stove 12 to extend from the front to the back with a plurality of fingers 22 for supporting cooking pans above a front gas burner 16 and a back gas burner 16. In FIGS. 1 and 2, the right hand grate 20 has been removed for clarity of illustration and also it will be understood that when the gas burners 16 are replaced by electric heating elements, the grate 20 will be omitted. The drip tray 24 extends from front to back and side to side of the cooktop 12, and surrounds the burners 16 for catching spills from the cooking pans. A drip tray 24 may be removable or permanently affixed to the range 12.

The cooking oven 14 of the range 10 is positioned in a conventional manner below the cooktop 12 and includes a top wall 26, right side wall 28, left side wall 30, rear wall 32, bottom wall 34 and a front opening 36 for an oven door (not shown). The oven 14 is provided with a bottom heating element 38, which is shown here as an electric heating element but also can be a gas burner element. Normally, the cooking oven 14 would also be provided with a broiler element adjacent the top wall 26 which may be an electric element, open flame gas burner or an infrared gas broiler, generally designated 40, as shown in the drawings. The cooking oven 14 is separately controlled by a knob 42 on the front of the range 10. The cooktop portion 12 and cooking oven 14 are mounted and supported by an exterior housing 10*a* of the cooking range 10 which may be provided with any additional conventional components and features. As thus far described, the cooking range 10 with a cooktop portion 12 and cooking oven 14 are conventional and the details thereof may vary substantially without departing from the present invention. Further, the cooking oven 14 may be of the built-in type without departing from the present invention, although the benefits of the present invention are more substantial when the cooking oven 14 is combined in a range 10 having a cooktop portion 12.

Referring now also to FIGS. 3–7, wherein the cooking range housing 10*a* is omitted for clarity of illustration, the cooking oven 14 is shown with an infrared gas broiler 40 of the type illustrated in U.S. patent application Ser. No. 09/055,977, filed Apr. 6, 1998, now allowed, assigned to the assignee of this application and the disclosure thereof is incorporated herein by reference, whereby a detailed description of the infrared gas broiler will not be set forth herein but rather only a brief description will be given. The infrared gas broiler 40 includes a venturi tube assembly 41 (FIG. 6) with a gas jet (not shown) that discharges gas through the venturi tube (not shown) to draw fresh air into the venturi tube assembly 41 and the gas/air mixture then passes downwardly through ceramic radiants 42 where the gas/air mixture burns as a sheet of flame on the bottom surface of the ceramic radiants 42 to heat the radiants to a temperature for emitting the infrared rays for broiling. An igniter (not shown) is provided immediately below the ceramic radiants 42 for igniting the gas/air mixture. A sheet metal box 43 supports the ceramic radiants 42 and forms a plenum for distributing the gas/air mixture from the venturi tube assembly 41 to the ceramic radiants 42, whereby all of the gas/air mixture from the venturi tube assembly 41 is forced through the ceramic radiants 42 for burning along the downwardly facing surface thereof. The sheet metal box 43 of the infrared gas broiler 40 is mounted on the top wall 26 of the oven 14 at an opening in the top wall 26 for the ceramic radiants 42.

Figure 4:
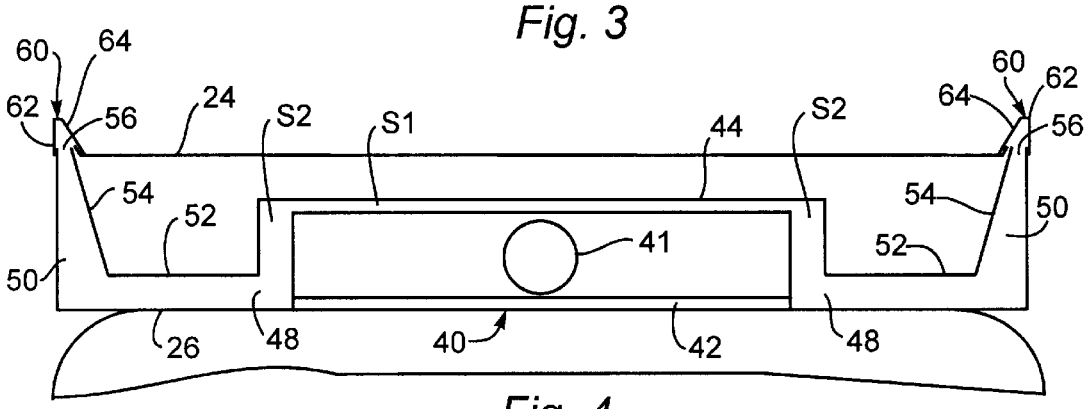
FIG. 4 is a fragmentary sectional elevation view taken substantially on the line 3—3 of FIG. 3 and illustrating the venting system of the present invention.
Figure 5:
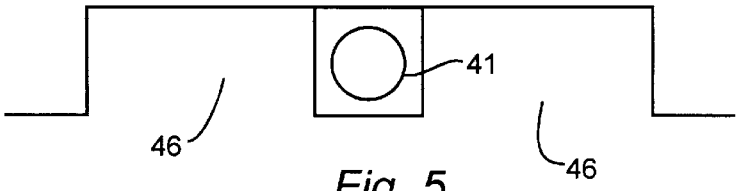
FIG. 5 is a fragmentary sectional elevation view taken on the line 5—5 of FIG. 3.
Figure 6:
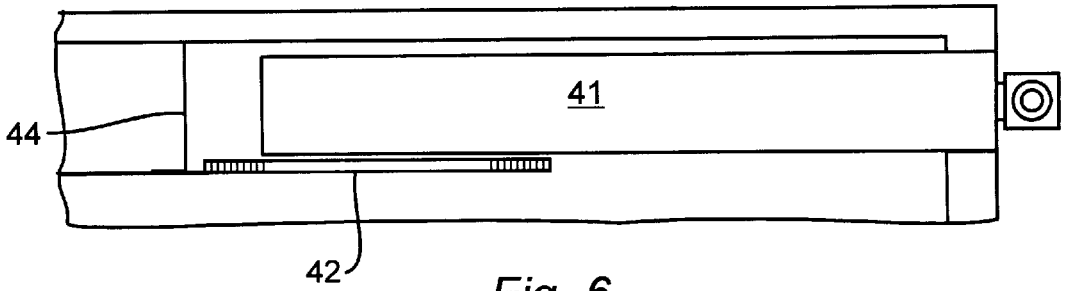
FIG. 6 is a fragmentary sectional elevation taken substantially on the line 6—6 of FIG. 3.
Figure 7:
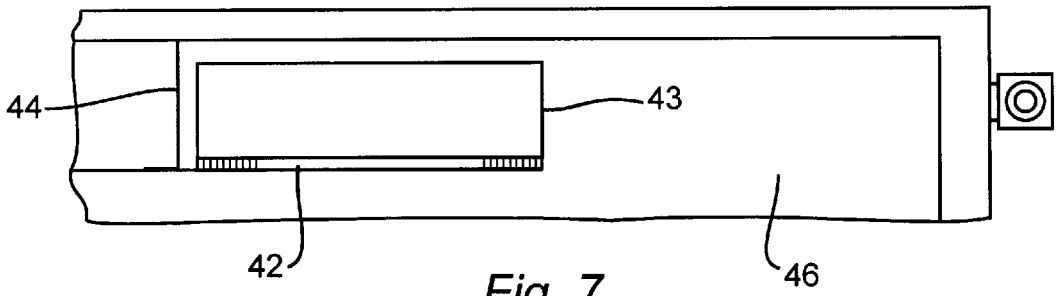
FIG. 7 is a fragmentary sectional elevation view taken substantially on the line 7—7 of FIG. 3.

A sheet metal housing 44 is also mounted on the top wall 26 of the oven 14 and encloses the infrared gas broiler 40. As shown in FIGS. 4 and 7, a space S1 is provided between the top wall of the sheet metal box 43 and the top wall of the sheet metal housing 44. Similarly, a space S2 is provided between the right and left side walls of the sheet metal box 43 and the right and left side walls, respectively, of the sheet metal housing 44. Although the width of the spaces S1 and S2 may vary substantially without departing from the present invention, it has been found desirable to have the space S1 about ⅜" wide and the space S2 about 1" wide.

As shown in FIGS. 4–7, the opening in the top wall 26 of the oven 40 is covered by the sheet metal housing 44 which is open at its bottom and, therefore, an open passageway 46 is formed between the oven cavity and the housing 44 at the rear of the oven behind the sheet metal box 43 of the infrared gas broiler 40. The passageway 46 communicates with the spaces S1 and S2 formed between the sheet metal box 43 and sheet metal housing 44.

The right and left side walls of the sheet metal housing 44 are provided with elongated openings 48, preferably rectangular with the long dimension being horizontal, at the base of the side walls adjacent the top wall 26 of the oven. Preferably, the openings 48 are located about midway between the front opening 36 and back wall 32 of oven 14. A flat duct 50 (also see FIG. 8) is provided on each side of the housing 44 and has an elongated inlet opening connected to the openings 48 in the side walls of the housing 44. Each duct 50 has a flat portion 52 extending laterally from the housing 44 to a location immediately above the side walls 28 and 30 of the oven 14. Each duct 50 also has an upwardly extending portion 54 communicating with the portion 52 and terminating at an upward end with an outlet 56. Preferably, the upwardly extending portion 54 is of a tapered shape that is wider at the bottom than at the top for improved gas flow. The upper end of the upwardly extending portion 54 of each duct 50 extends to or through the drip tray 24 or other component of the cooktop portion 12 of the range 10.

Figure 8:
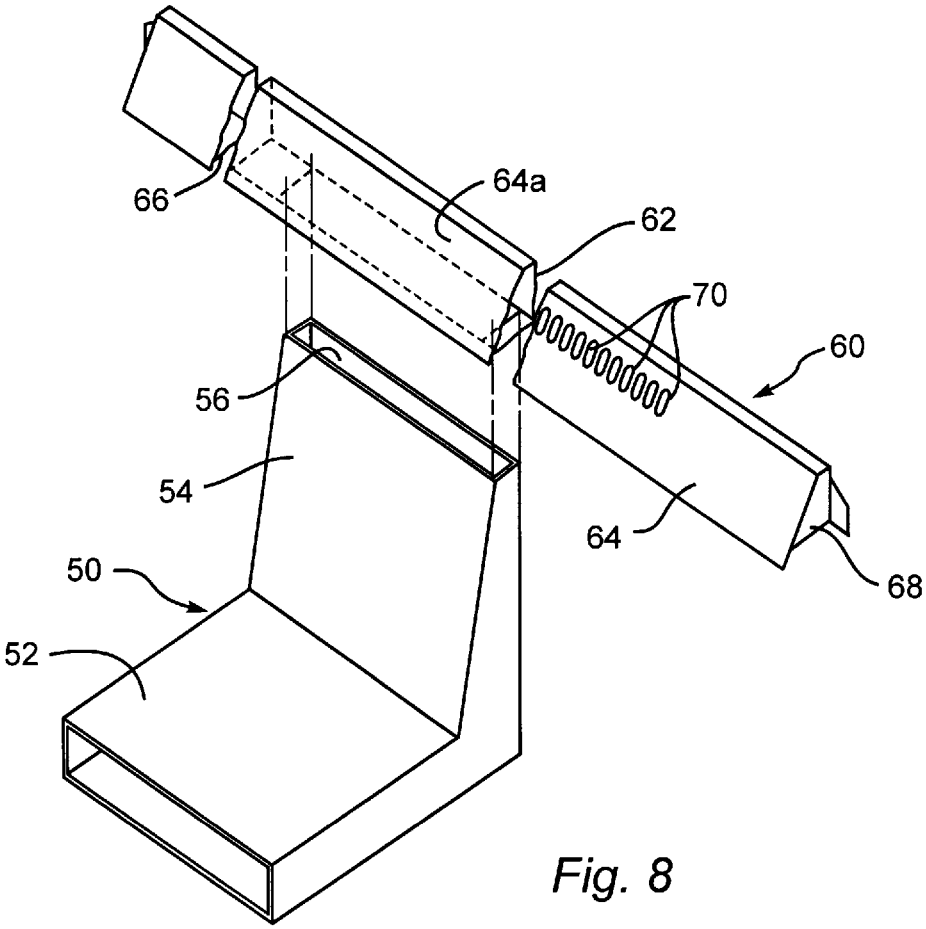
FIG. 8 is an exploded perspective view of the duct and manifold components of the venting system of the present invention.

A vent manifold 60 also (see FIG. 8) is provided on the top of and on either side of the cooktop portion 12 of the cooking range 10 at a location immediately above the upwardly extending portion 54 of each duct 50. Each vent manifold 60 has an elongated opening on the bottom to fit over and communicate with the outlet opening 56 from the duct 50. The vent manifold 60 is preferably of a generally triangular shape, as shown, with a vertical outside wall 62, an inclined inside wall 64, a bottom wall 66 having the bottom opening for fitting over the duct outlet opening 56, and end closures 68. The central portion 64*a*, from front to rear, of the inclined wall 64 above the duct outlet 56 is preferably solid, i.e. not perforated, for causing the exhaust gases to be distributed forwardly and rearwardly within the vent manifold 60. The forward and rearward portions of the vent manifold 60 are provided with a plurality of exhaust openings 70 which preferably are vertically extending slots located in spaced relation along the wall 64, as shown in FIGS. 1 and 8. By this arrangement, each of the vent manifolds 60 causes a relatively even distribution of the hot exhaust gases from the oven cavity along the rear half and front half of the cooktop portion 12 of the cooking range 10. Moreover, by this arrangement for distributing the hot exhaust gases, the operation of the gas burners 16 is not adversely affected.

As will be apparent to those skilled in the art from the foregoing description of the preferred embodiment, the gases of combustion created in the oven 14 during operation of the gas burning heating elements, either a bottom element or broiler element, such as infrared burner 40, rise from the rear and central portion of the oven through the passageway 46 through the spaces S1 and S2 to enter the pair of ducts 50 through openings 48, and then the gases flow upwardly in the ducts 50 through the outlet openings 56 into the vent manifolds 60 from which the gases are discharged through the exhaust openings 70 at the front and rear portions of both sides of the cooktop portion 12 of the range 10. This arrangement provides an even flow of the exhaust gases from the oven cavity from central locations on both sides of the oven and adequately distributes the exhaust gases to prevent any excessively hot spots above or around the cooktop portion 12 of the range 10.

Figure 9:
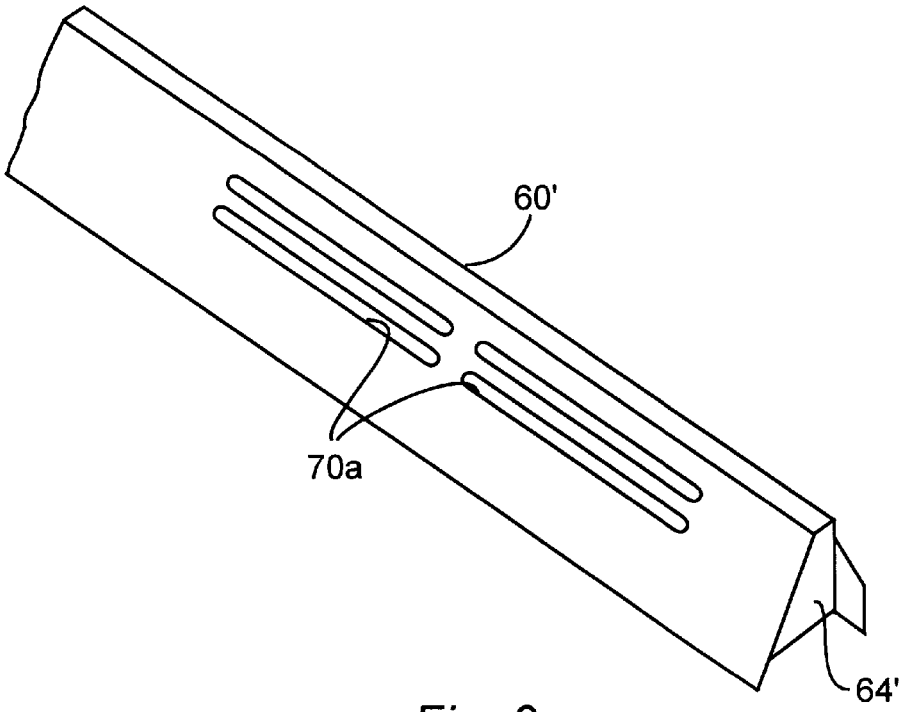
FIG. 9 is a perspective view of an alternate form of the manifold component shown in FIG. 8 for the venting system of the present invention.

Referring now to FIG. 9, a modified form of vent manifold 60' is shown with a plurality of openings 70*a* that extend in the horizontal direction along the inclined wall 64'. The horizontal slots 70*a* may be longer or shorter than illustrated and of fewer or larger numbers. Again, the exhaust openings 70*a* serve to distribute the exhaust gases along the front and rear portions of the cooktop portion 12 of the oven 10.

Figure 10:
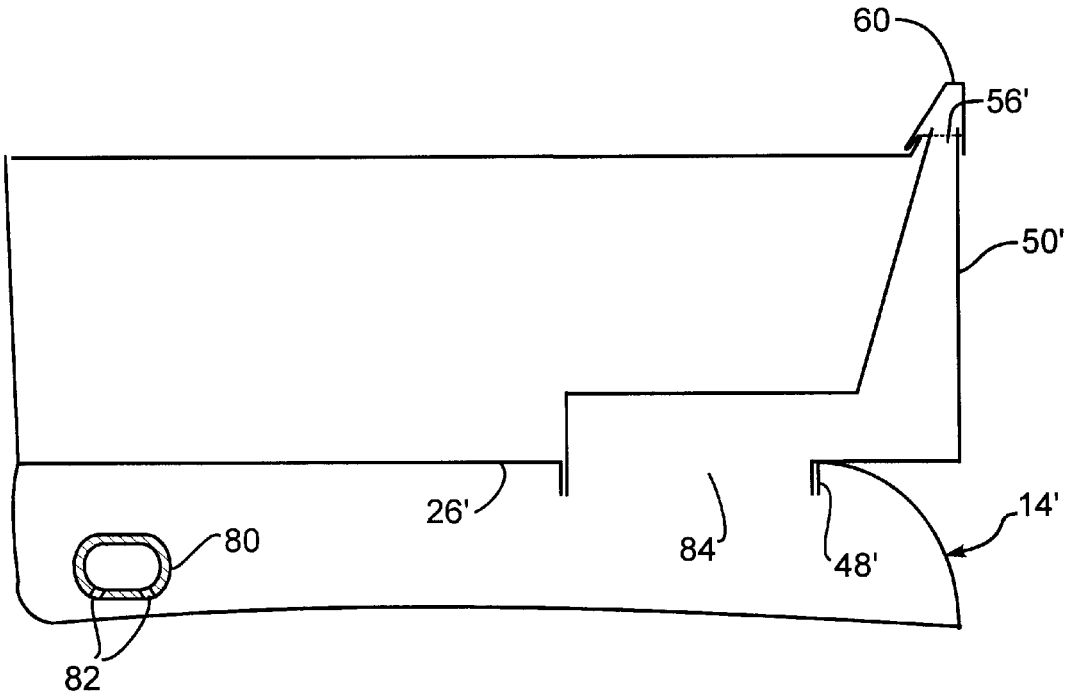
FIG. 10 is a fragmentary sectioanl elevation view similar to a portion of FIG. 4 but showing an alternate form of duct component of the venting system of the present invention.

Referring now to FIG. 10, which is a fragmentary sectional elevation similar to FIG. 4 of a modified form of the vent system of the present invention, the cooking oven 14' is shown with a conventional gas broiler element 80 positioned near the top wall 26' and the burner is provided with a multiplicity of holes 82 from which a gas/air mixture is discharged and ignited for creating the broiler heat. In this modified form of the invention, since there is no sheet metal housing 44 enclosing an infrared burner 40, the top wall 26' of the oven 14' is provided with an elongated opening 48' toward each lateral side of the oven and preferably located centrally from front to rear. A flat duct 50' is provided on each side of the oven and has an inlet opening 84 that fits into the opening 48' for receiving the combusted gases from the oven 14'. As described with respect to the preferred embodiment, the upper end of duct 50' has an outlet opening 56' that fits into an opening in the bottom of the vent manifold 60, which may be the same as the preferred embodiment or the modified form shown in FIG. 9. This modified embodiment of the venting system of the invention performs in substantially the same manner as the preferred embodiment of FIGS. 1–8 by evenly distributing the exhaust gases from the cooking oven along both sides of the cooking range.

Thus, the present invention provides a venting system for cooking ovens having at least one gas burning heating element in which the system exhaust the gases of combustion from the oven along both upper sides of the oven rather than the rear of the oven, whereby exhaust openings along the rear of the oven that reduce the available working depth of the cooktop are eliminated and no separate venting, such as ducting extending from the rear of the oven, is necessary. While specific embodiments and modifications of the present invention have been shown and described, other embodiments and modifications that come within the scope of the present invention will readily appear to those skilled in the art from the foregoing descriptions and the accompanying drawings.

The invention claimed is:

1. A venting system for a gas oven, comprising: a pair of flat ducts located on top of and adjacent each side of the oven, each said duct having an elongated inlet opening connected to openings in the top of the oven for receiving gases from the oven, each of said ducts having an upwardly extending portion that is elongated in the direction from front to rear, and each said upwardly extending portion terminating at an upper end with an elongated outlet opening; and a vent manifold mounted above each said duct and having a downwardly facing elongated opening communicating with said outlet opening of that said duct, each said vent manifold extending from front to rear above the oven, and each said vent manifold having a plurality of exhaust openings spaced along said vent manifold.

2. The venting system of claim 1, wherein each said flat duct includes a horizontal portion extending toward the other said flat duct before connecting to the openings in the top of the oven.

3. The venting system of claim 2, wherein each said duct is located centrally from front to rear of the oven.

4. The venting system of claim 3, wherein each said flat duct includes a horizontal portion extending toward the other said flat duct before connecting to the openings in the top of the oven.

5. The venting system of claim 2, wherein each said duct includes a downwardly facing inlet opening at a terminal end of said horizontal portion for connecting to an upwardly facing opening in the oven top.

6. The venting system of claim 1, wherein each said duct is located centrally from front to rear of the oven.

7. The venting system of claim 6, wherein said exhaust opening in each said vent manifold are located only forwardly and rearwardly of said downwardly facing opening in said vent manifold.

8. The venting system of claim 1, wherein each said vent manifold includes a solid wall portion above said downwardly facing opening in said vent manifold for diverting oven gases toward said exhaust openings.

9. The venting system of claim 1, wherein said exhaust openings include a plurality of spaced and vertically extending slots.

10. The venting system of claim 1, wherein said exhaust openings include a plurality of spaced and horizontally extending slots.

11. A venting system for a gas oven having a top wall, a right side wall, a left side wall, a rear wall and a front opening for a door, comprising: a pair of elongated oven openings in the top wall with each said opening being elongated in a direction from the rear wall toward the front opening; and a flat duct having an elongated inlet opening connected to each of said elongated oven openings for receiving gases from the oven, one of said ducts having an upwardly extending portion located at and above the right side wall and the other said duct having an upwardly extending portion located at and above the left side wall, and each said upwardly extending portion terminating at an upper end with an outlet opening for the gases.

12. The venting system of claim 11, wherein each said flat duct is spaced from both the front opening and the rear wall.

13. The venting system of claim 12, wherein each said outlet opening is elongated in a direction along a said side wall.

14. The venting system of claim 13, wherein each said outlet opening is located centrally from front to rear of the oven.

15. The venting system of claim 14, wherein each said flat duct includes a horizontal portion extending away from the other said flat duct before connecting to said upwardly extending portion.

16. The venting system of claim 15, wherein each said duct includes a horizontally facing inlet opening at a terminal end of said horizontal portion for connecting to a horizontally facing opening in the oven top wall.

17. The venting system of claim 16, wherein each said duct is located centrally from front to rear of the oven.

18. The venting system of claim 15, wherein each said duct includes a downwardly facing inlet opening at a terminal end of said horizontal portion for connecting to an upwardly facing opening in the oven top wall.

19. The venting system of claim 11, wherein each said duct is located centrally from front to rear of the oven.

20. The venting system of claim 19, wherein a vent manifold is mounted above each said outlet opening, and each said vent manifold extends in a direction from front to rear of the oven for distribution of the oven gases along the sides of the oven.

21. The venting system of claim 20, wherein a cooking range is provided above the oven and said outlet openings are on opposite sides of said cooking range.

22. A venting system for a gas oven having a top wall, a right side wall, a left side wall, a rear wall and a front opening for a door, comprising:

a pair of elongated oven openings in the top wall, said openings being spaced from each other, the side walls, the rear wall and the front opening, each said opening being elongated in a direction from the rear wall toward the front opening;

a pair of flat ducts, each said duct having an elongated inlet opening connected to one of said elongated oven openings for receiving combusted gases from the oven, each of said ducts having an upwardly extending portion with an elongated cross-section in the direction from the rear wall toward the front opening, said upwardly extending portion of one said duct being located directly above the right side wall and said upwardly extending portion of the other said duct being located directly above the left side wall, and each said upwardly extending portion terminating at an upper end with an elongated outlet opening; and a vent manifold mounted on each said duct with a downwardly facing elongated opening communicating with said elongated outlet opening of that said duct, each said vent manifold extending from substantially above the rear wall to substantially above the front opening, and each said vent manifold having a plurality of exhaust openings spaced along portions of said vent manifold forwardly and rearwardly of said downwardly facing elongated opening, said exhaust openings of each said vent manifold facing in a direction toward the other said vent manifold.

23. The venting system of claim 22, wherein each said flat duct includes a horizontal portion extending toward the other said flat duct before connecting to the openings in the top of the oven.

24. The venting system of claim 23, wherein each said duct includes a horizontally facing inlet opening at a terminal end of said horizontal portion for connecting to a horizontally facing opening in the oven top.

25. The venting system of claim 23, wherein each said duct includes a downwardly facing inlet opening at a terminal end of said horizontal portion for connecting to an upwardly facing opening in the oven top.

26. In a venting system for a cooking range having a cook top portion with gas burners and a gas oven having a top wall, a right side wall, a left side wall, a rear wall and a front opening for a door, an improvement comprising:

a pair of elongated oven openings in the top wall, said openings being spaced from each other, the side walls, the rear wall and the front opening, and each said opening being elongated in a direction from the rear wall toward the front opening;

a pair of flat ducts, each said duct having an elongated inlet opening connected to one of said elongated oven openings for receiving combusted gases from the oven, each of said ducts having an upwardly extending portion with an elongated cross-section in the direction from the rear wall toward the front opening, said upwardly extending portion of one said duct being located directly above the right side wall and said upwardly extending portion of the other said duct being located directly above the left side wall, and each said upwardly extending portion terminating at an upper end with an elongated outlet opening; and a pair vent manifolds mounted on and along right and left sides of the cooktop portion of the range and spaced from the gas burners, each vent manifold positioned above a said duct with a downwardly facing elongated opening communicating with said elongated outlet opening of that said duct, each said vent manifold extending from substantially the rear to substantially the front of said cooktop portion of the range, and each said vent manifold having a plurality of exhaust openings spaced along portions of said vent manifold forwardly and rearwardly of said downwardly facing elongated opening, said exhaust openings of each said vent manifold facing in a direction toward the other said vent manifold.

27. The venting system of claim 26, wherein each said flat duct includes a horizontal portion extending toward the other said flat duct before connecting to the openings in the top of the oven.

28. The venting system of claim 27, wherein each said duct includes a horizontally facing inlet opening at a terminal end of said horizontal portion for connecting to a horizontally facing opening in the oven top.

29. The venting system of claim 27, wherein each said duct includes a downwardly facing inlet opening at a terminal end of said horizontal portion for connecting to an upwardly facing opening in the oven top.

* * * * *